US009840055B2

(12) United States Patent
Janke et al.

(10) Patent No.: US 9,840,055 B2
(45) Date of Patent: Dec. 12, 2017

(54) ROTARY PRESS

(71) Applicant: Fette Compacting GmbH, Schwarzenbek (DE)

(72) Inventors: Annett Janke, Zittow (DE); Sven Kolbe, Büchen (DE); Adam Hamdan, Geesthacht (DE)

(73) Assignee: Fette Compacting GmbH, Schwarzenbek (DE)

( * ) Notice: Subject to any disclaimer, the term of this patent is extended or adjusted under 35 U.S.C. 154(b) by 366 days.

(21) Appl. No.: 14/705,311

(22) Filed: May 6, 2015

(65) Prior Publication Data

US 2015/0321435 A1 Nov. 12, 2015

(30) Foreign Application Priority Data

May 7, 2014 (DE) ..... 10 2014 106 405
Sep. 12, 2014 (DE) ..... 10 2014 113 211

(51) Int. Cl.
*B30B 11/08* (2006.01)
*B30B 15/00* (2006.01)
(Continued)

(52) U.S. Cl.
CPC ..... *B30B 11/08* (2013.01); *B30B 15/0023* (2013.01); *B30B 15/026* (2013.01); *B30B 15/028* (2013.01); *B30B 15/302* (2013.01)

(58) Field of Classification Search
CPC ..... B30B 11/08; B30B 15/028; B30B 15/026; B30B 15/0023; B30B 15/302; B30B 15/32; B30B 11/027; B30B 9/00; B30B 15/029; B30B 15/0035; B30B 15/0041
USPC ..... 74/813 R, 814, 825, 826, 813 L; 425/145, 265, 267, 402, 344, 345, 451, 425/451.4
See application file for complete search history.

(56) References Cited

U.S. PATENT DOCUMENTS 5,004,413 A 4/1991 Stopforth
6,676,863 B2 1/2004 Christiaens et al.
(Continued)

FOREIGN PATENT DOCUMENTS

DE 60126355 T2 10/2007
DE 10 2009 020 196 A1 11/2010
(Continued)

*Primary Examiner* — Matthew Daniels
*Assistant Examiner* — Leith S Shafi
(74) *Attorney, Agent, or Firm* — Young Basile Hanlon & MacFarlane, P.C.

(57) ABSTRACT

A rotary press comprises a press frame and a rotor arranged thereon. The rotor has a die plate, an upper punch receiver receiving upper punches, a lower punch receiver receiving lower punches, an upper cam that guides the upper punches, and a lower cam that guides the lower punches. A rotor drive can drive the rotor rotationally. Within at least one dosing station, material is filled into receivers of the die plate for pressing. An upper pressing station has an upper pressing roller and a lower pressing station has a lower pressing roller. Coupling means couples at least one drive that operates the rotary press to the rotor such that, with movement of the at least one drive, the rotor is raised out of its operating position and into a removal position where the rotor can be removed out of the press frame in a lateral direction.

16 Claims, 4 Drawing Sheets

(51) Int. Cl.
*B30B 15/30* (2006.01)
*B30B 15/02* (2006.01)

(56) References Cited

U.S. PATENT DOCUMENTS

| | | | | |
|---|---|---|---|---|
| 7,942,662 | B2 * | 5/2011 | Roemer | B30B 11/08 425/345 |
| 8,550,804 | B2 | 10/2013 | Mies et al. | |
| 2003/0042639 | A1 * | 3/2003 | Christiaens | B08B 3/02 264/39 |
| 2009/0191297 | A1 * | 7/2009 | Malick | B30B 11/08 425/345 |

FOREIGN PATENT DOCUMENTS

| | | | |
|---|---|---|---|
| EP | 2 065 176 | A2 | 6/2009 |
| WO | 02074527 | A1 | 9/2002 |
| WO | 2009112886 | A1 | 9/2009 |

* cited by examiner

ROTARY PRESS

CROSS-REFERENCE TO RELATED APPLICATION

This application claims priority to German patent application no. 10 2014 106 405.4, filed May 7, 2014, and German patent application no. 10 2014 113 211.4, filed Sep. 12, 2014, each of which is incorporated herein in its entirety by reference.

TECHNICAL FIELD

The invention relates to a rotary press.

BACKGROUND

A rotary press may comprise a press frame and a rotor arranged thereon having a die plate, an upper punch receiver for receiving a plurality of upper punches, a lower punch receiver for receiving a plurality of lower punches, an upper cam for carrying upper cam elements for guiding the upper punches, and a lower cam for carrying lower cam elements for guiding the lower punches. A rotor drive can drive the rotor rotationally. Material to be pressed is filled into receivers of the die plate at one or more dosing stations. At least one upper pressing station has at least one upper pressing roller, and at least one lower pressing station has at least one lower pressing roller.

SUMMARY

With rotary presses it is occasionally necessary to remove the rotor out of the press frame for maintenance or changing operating parameters. In an arrangement as described above, the rotor must be lifted from the rotor shaft connected to the rotor drive. Then, the rotor can be removed laterally from the press frame. Separate lifting equipment (e.g., a lift truck) that has drives and transmission suitable for lifting the rotor is used. This is time-consuming, which impacts the availability of the rotary press. Furthermore, this lifting equipment is expensive with respect to cost and required space. It has only limited cleaning possibilities and to some extent requires additional media that must be provided and maintained, for example for supplying hydraulics.

In contrast, the teachings herein provide a rotary press where the rotor can be removed from the press frame in a simple manner.

For a rotary press as described herein, coupling means is provided with which at least one drive of the rotary press, used for operating the rotary press, can be coupled to the rotor in such a manner that with a movement of the at least one drive, the rotor is raised out of its operating position occupied for producing pressings. The rotor is raised into a removal position. The rotor can be removed from the removal position out of the press frame in a lateral direction.

The die plate of the rotor has recesses in which the powder filled in the dosing station is pressed into pressings, in particular tablets. The die plate can be comprised of ring segments or be integrally annular. The rotary press comprises, in particular, a plurality of upper punches received in the upper punch receiver rotating with the rotor, and a plurality of lower punches received in the lower punch receiver rotating with the rotor. The upper and lower punches interact with the recesses in the die plate for producing the pressings. The rotary press additionally comprises, in particular, upper cam elements for guiding the upper punches held at the upper cam, and lower cam elements for guiding the lower punches held at the lower cam.

The coupling means may be provided via which a drive of the rotary press that is otherwise present and used for operating the rotary press can be used for lifting the rotor into the removal position thereof. The coupling means couples this drive to the rotor. In the removal position, the rotor can be lifted from the rotor shaft connected to the rotor drive such that it can be removed out of the press frame in the lateral direction, for example using an appropriate removal device. Here, however, no lifting forces must be exerted by the removal device for lifting the rotor. Accordingly, this removal device does not require a lift drive. Also by means of the coupling means, the rotor can also be lowered out of the removal position thereof into the operating position thereof, using the drive for the rotary press that is already used and present for operation. This can occur without attaching additional components to the drive.

The upper drives of the rotary press and/or lower drives can be used for raising, or respectively lowering, the rotor. In a particularly advantageous manner, for lateral removal of the rotor, the movements of stations of the rotary press into a parked position that are required anyway can be used, thereby resulting in additional time savings and thus an increase of the availability of the rotary press. In this way, the set-up of a separate lifting device is omitted. Cleaning is facilitated because no additional drive parts are required in the press space. In addition, the maintenance of additional equipment, in particular an external lift device, is omitted. The costs are reduced and the operation is facilitated because the rotor can be moved into the removal position thereof completely automatically without manual intervention.

According to one design, the at least one drive that can be coupled by the coupling means to the rotor for operating the rotary press can be at least one dosing station drive that serves for adjusting the height of the at least one dosing station.

For removing the rotor, generally the upper pressing stations are moved upward and the lower pressing stations are moved downward, so that the rotor can be removed out of the press frame between the upper and lower pressing rollers. In a particularly advantageous manner, therefore the at least one drive that can be coupled via the coupling means to the rotor for operating the rotary press can be at least one pressing station drive that serves for adjusting the height of the at least one upper and/or at least one lower pressing station. The pressing station drives of the rotary press are capable of applying the forces required for lifting the rotor. The movement of the pressing stations into the respective parked position thereof required anyway for removing the rotor is advantageously also used for raising the rotor into the removal position. With a plurality of upper or a plurality of lower pressing station drives, in particular, all upper pressing station drives and/or all lower pressing station drives can be coupled via the coupling means to the rotor for raising (or lowering) the rotor.

The coupling means can comprise at least one tractive element fastened on one side to at least one upper pressing station, in particular to at least one fork plate supporting an upper pressing roller, and on the other side to the rotor, in particular the upper cam or the upper punch receiver of the rotor. At least one tractive element can be fastened in each case to each upper pressing station drive, in particular to each upper fork plate. The tractive elements are then all fastened additionally to the rotor. During a movement of the upper pressing station drive, or respectively the upper pressing station, into the parked position, the tractive elements also move the rotor upward into the removal position.

The at least one tractive element can be attached to a support attachment piece arranged at the upper cam. In the removal position of the rotor, a removal arm of a removal device can engage at the support attachment piece for lateral removal of the rotor from the press frame. Such a support attachment piece can be designed mushroom-shaped for example.

The at least one tractive element can be releasably fastened to the at least one upper pressing station and/or releasably fastened to the rotor. Further, the at least one tractive element can be at least one pull rod.

The coupling means, according to a further design, can comprise at least one push element. The push element may be fastened at one side to at least one lower pressing station, in particular to at least one fork plate supporting a lower pressing roller, and on the other side to the rotor, in particular to the lower cam or the lower punch receiver of the rotor. Further, at least one push element can be attached to each lower pressing station drive if a plurality of lower pressing station drives is present. The push elements are then all attached also to the rotor. In this case, the lower pressing station drives, with an upward movement via the push elements, push the rotor also upward into the removal position thereof. The at least one push element can be at least one push bracket. The high forces are transferred safely via such a push bracket.

In turn, the at least one push element can be releasably fastened to the at least one lower pressing station and/or releasably fastened to the rotor.

Alternatively, the rotary press comprises a rotor shaft coupled on one side to the rotor drive and on the other side to the rotor, wherein the coupling means comprises a lifting collar, mounted rotatably surrounding the rotor shaft and resting against the rotor, in particular the lower cam or the lower punch receiver of the rotor, and at least one engagement element at the lifting collar that, during rotation of the lifting collar, can be selectively brought into and out of engagement with at least one lower pressing station. With an engagement between the at least one lower pressing station and the at least one engagement element, the lifting collar and thus the rotor are raised by an upward movement of the at least one lower pressing station. By rotating the lifting ring, or respectively the lifting collar, with a plurality of lower pressing station drives, the engagement element or possibly the plurality of engagement elements, can be brought into engagement with all lower pressing station drives, in particular in each case a fork plate of the lower pressing station drives holding the lower drive rollers.

According to a further design, the coupling means may comprise a rotatably mounted lifting ring, at which at least one engagement element is provided. Through rotation of the lifting ring, the at least one engagement element can be brought selectively into or out of engagement with the rotor. With an engagement between the rotor and the at least one engagement element, the lifting ring and thus the rotor can be raised through a movement of the at least one lower pressing station.

According to a further design, the coupling means may comprise at least one lift lever coupled on one side to at least one lower pressing station drive and on the other side to the rotor, in particular to the lower cam or to the lower punch receiver of the rotor. The rotor, with a downward movement of the at least one lower pressing station by the at least one lower pressing station drive, is raised by the at least one lift lever. In turn, with a plurality of lower pressing station drives, in each case at least one lift lever can be coupled to each lower pressing station drive, in particular in each case to a fork plate of the lower pressing station drive holding the lower pressing roller. The lift levers are then in turn all coupled to the rotor. With this design, a lifting mechanism in the manner of a rocker can be realized using the lifting lever. A downward movement of the lower pressing station drive into the parked position causes a raising of the rotor into the removal position. Due to the lifting mechanism, a transmission ratio can be realized that realizes short movement paths and movement times on the pressing station side. The at least one lifting lever can be coupled to the rotor, via at least one suitable element, for example at least one lifting rod engaging at the rotor, in particular at the lower cam or at the lower punch receiver of the rotor.

The at least one pressing station drive can be a spindle drive. Spindle drives can transfer high forces in a precise manner. They typically have in each case a spindle and a spindle nut, wherein the spindle or the spindle nut are generally driven rotationally by an electric motor. The spindle or the spindle nut is thereby moved axially. The lift lever is then coupled to, in each case, the axially moving component, namely the spindle, or respectively the spindle nut. For instance, the spindle of each of the lower pressing station may drive, then actuate the lift mechanism via the lift lever, which engages at the rotor and raises, or respectively lowers, the rotor.

BRIEF DESCRIPTION OF THE DRAWINGS

Example embodiments of the invention are explained in the following in more detail using the drawings in which.

The same reference numbers refer to the same objects in the figures unless indicated otherwise.

DETAILED DESCRIPTION

Figure 1:
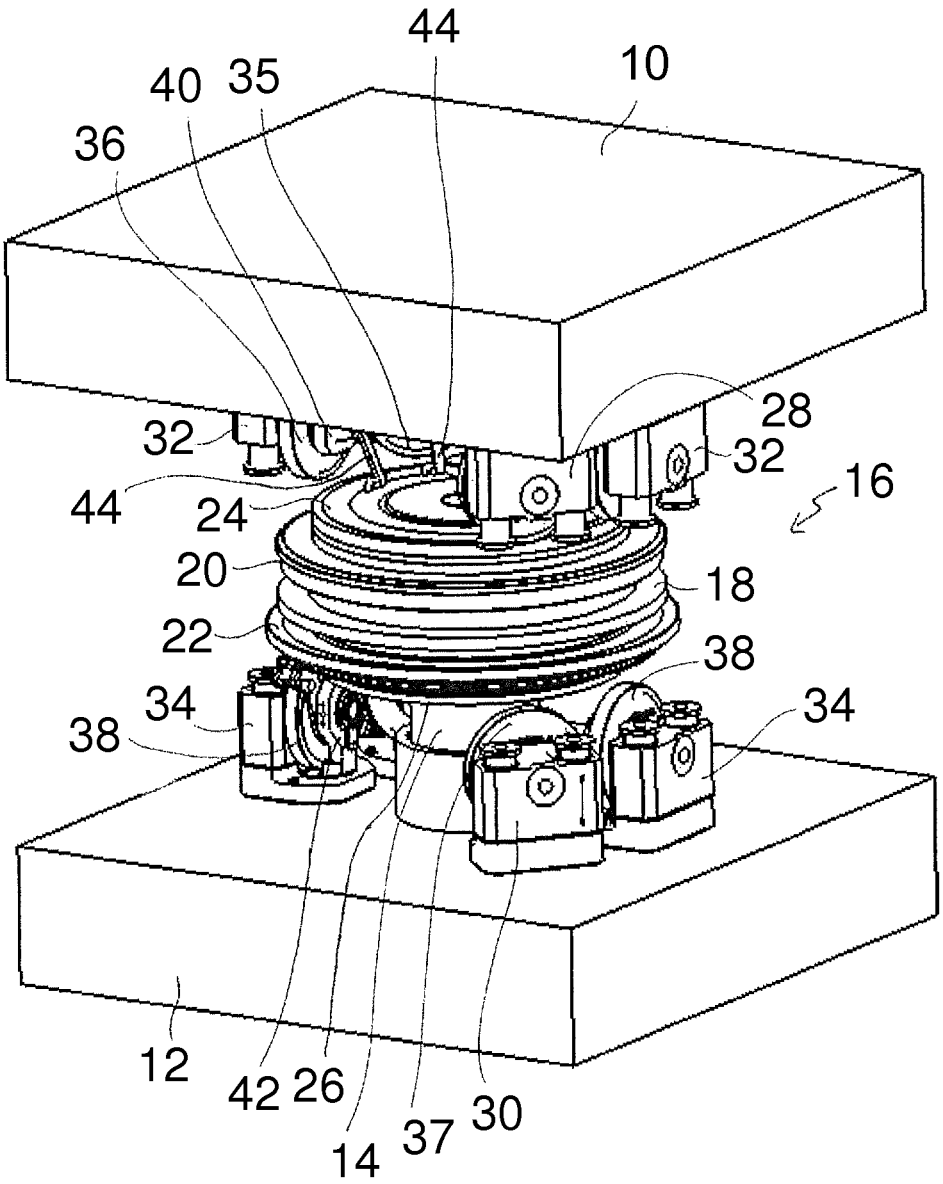
FIG. 1 is a perspective view of a part of a rotary press according to a first exemplary embodiment of the teachings herein.

FIG. 1 shows an upper carrier plate 10 and a lower carrier plate 12 of a press frame of a rotary press. A rotor 16 of the rotary press is arranged on a rotor shaft 14 connected to a rotor drive. The rotor 16 comprises a die plate 18 and an upper punch receiver 20 for receiving a plurality of upper punches and a lower punch receiver 22 for receiving a plurality of lower punches. Additionally, the rotor 16 comprises an upper cam 24 for carrying upper cam elements for guiding the upper punches, and a lower cam 26 for carrying lower cam elements for guiding the lower punches.

The rotary press further comprises two pairs of upper pressing stations and two pairs of lower pressing stations. The two upper pressing stations each comprise an upper pre-pressing station having an upper pre-pressing guide housing 28. The two lower pressing stations each comprise a lower pre-pressing station having a lower pre-pressing guide housing 30. Additionally, the upper pressing stations each have an upper main pressing station with an upper main pressing station guide housing 32. The two lower pressing stations likewise each comprise a lower main pressing station with a lower main pressing guide housing 34. The upper pressing stations each further comprise an upper pre-pressing roller 35 and an upper main pressing roller 36. Similarly, the lower pressing stations each have a lower pre-pressing roller 37 and a lower main pressing roller 38. The pressing rollers 35, 36, 37, 38 are each held by an upper fork plate 40, or respectively a lower fork plate 42. The elements thus far have been used in some known rotary presses.

As seen in FIG. 1, pull rods 44 are attached with one end to each of the upper fork plates 40 supporting the upper main pressing rollers 36, which are attached at the other end to the upper cam 24 of the rotor 16. Thus, a total of four pull rods 44 are provided, of which only two can be seen in FIG. 1. The upper and lower pressing stations of the rotary press each comprise an upper, or respectively lower pressing station drive, each comprising an upper drive motor 46, or respectively a lower drive motor 48, seen in FIG. 2. The drive motors 46, 48 act on the upper and lower pressing stations via gears 50, 52, respectively. For reasons of clarity, the pressing station drives are not shown in FIGS. 1 and 3 to 5. The upper and lower pressing stations can be moved upward and downward, respectively, via the upper and lower pressing station drives. FIG. 1 shows the rotor 16 in the operating position thereof, in which it produces pressings. The rotor 16 can now be raised, through upward movement of the upper pressing station drives and thus the upper pressing stations via the pull rods 44, into the removal position thereof, in which it can be removed laterally out of the press frame, for example by means of a removal device. In order to have sufficient space for removing the rotor, the lower pressing stations can simultaneously be moved downward into a parked position by means of their pressing station drives. Thus, in a simple manner, the upward movement in this case of the upper pressing station drives into their parked position is used to simultaneously lift the rotor 16 into the removal position thereof.

Figure 2:
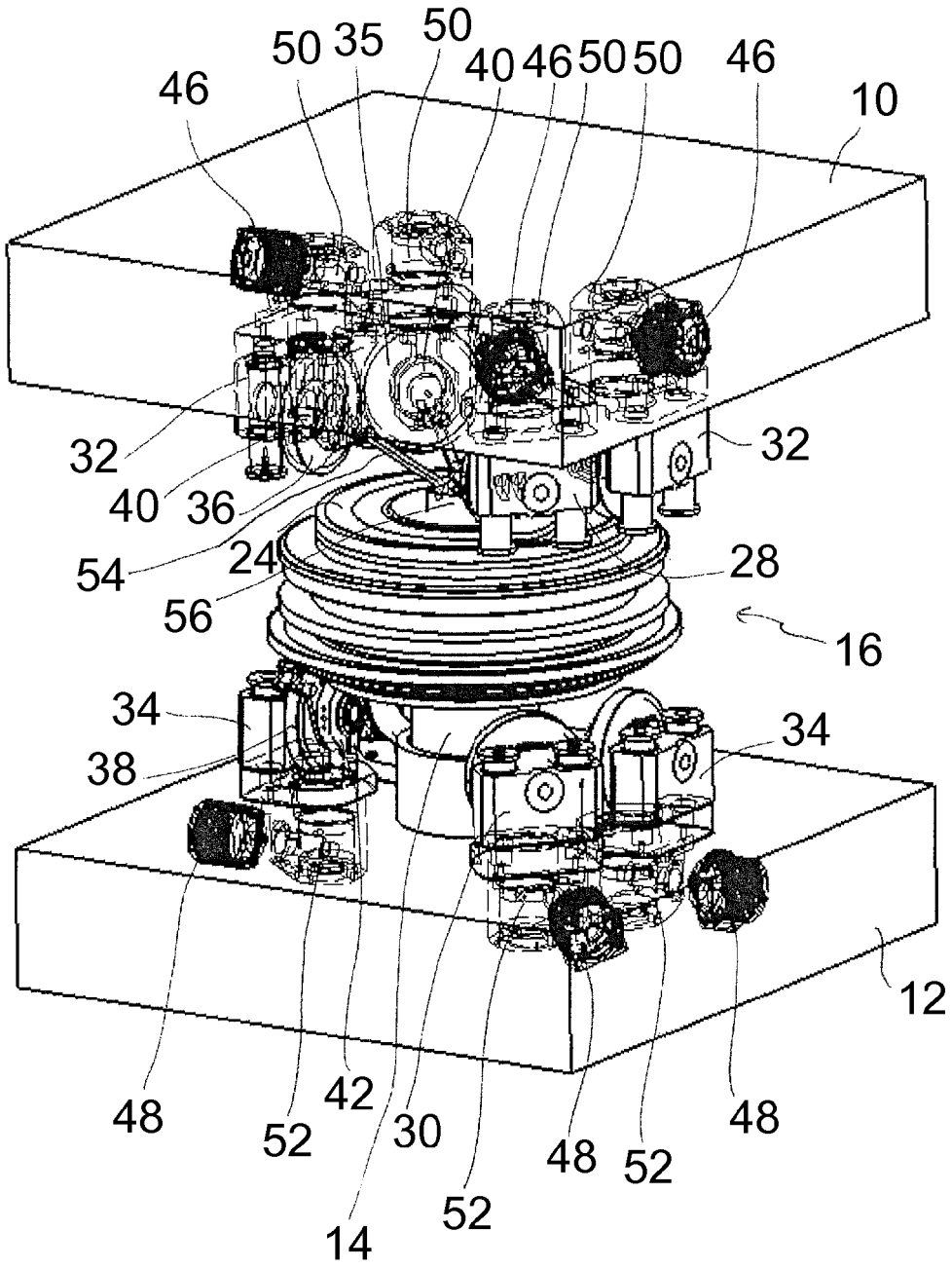
FIG. 2 is a partially transparent, perspective view of a part of a rotary press according to a second exemplary embodiment of the teachings herein.

FIG. 2 shows a further example embodiment of a rotary press according to the teachings herein. The rotary press shown in FIG. 2 corresponds largely to the rotary press shown in FIG. 1 but differs in that instead of the pull rods 44 attached at the upper cam 24, pull rods 54 are provided each of which is attached at one side to the upper fork plates 40 of the upper pressing stations and on the other side to a central support attachment piece 56 on the upper cam 24. This support attachment piece 56 can be formed mushroom-shaped for example, and serves to engage a removal device for lateral removal of the rotor 16, in the removal position thereof, out of the press frame. Such a mushroom-shaped attachment piece 56 can be seen for example in FIG. 3. The attachment piece 56 can be provided with all example embodiments. In addition, the rotor 16 shown in the example in FIG. 2 is raised into the removal position thereof by an upward movement of the upper pressing station drives, as was explained already with reference to FIG. 1.

Figure 3:
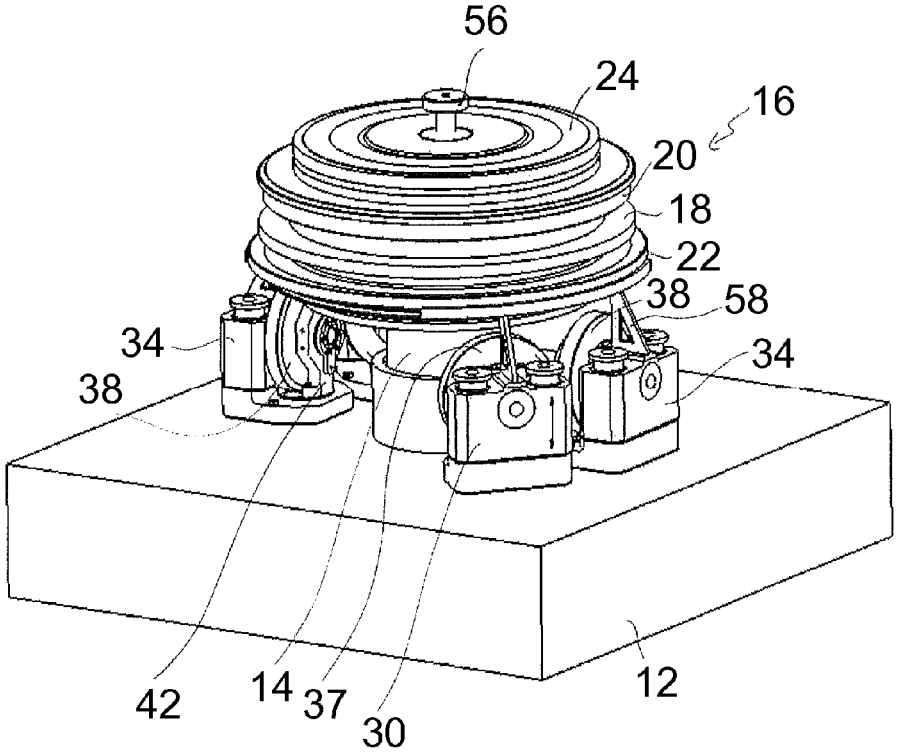
FIG. 3 is a perspective view of a part of a rotary press according to a third exemplary embodiment of the teachings herein.

FIG. 3 shows a further example embodiment of a rotary press according to the teachings herein. In this case, the upper carrier plate 10 and the upper pressing stations are not shown for illustrative purposes. Again, the example embodiment shown in FIG. 3 corresponds largely to the example embodiment of FIG. 1. However, instead of the pull rods 44 connected to the upper pressing station in FIG. 1, the example embodiment of FIG. 3 includes a total of four push brackets 58, of which in each case one side is attached on the lower pre-pressing guide housings 30 and the lower main pressing guide housings 34 of the lower pressing station, and the other side engages at the bottom side of the rotor 16, in particular at the lower punch receiver 22. Through a movement of the lower pressing stations, in particular the lower pre-pressing guide housings 30 and the lower main pressing guide housing 34, the rotor 16 can be moved out of the operating position thereof into the removal position thereof via the push bracket 58.

Figure 4:
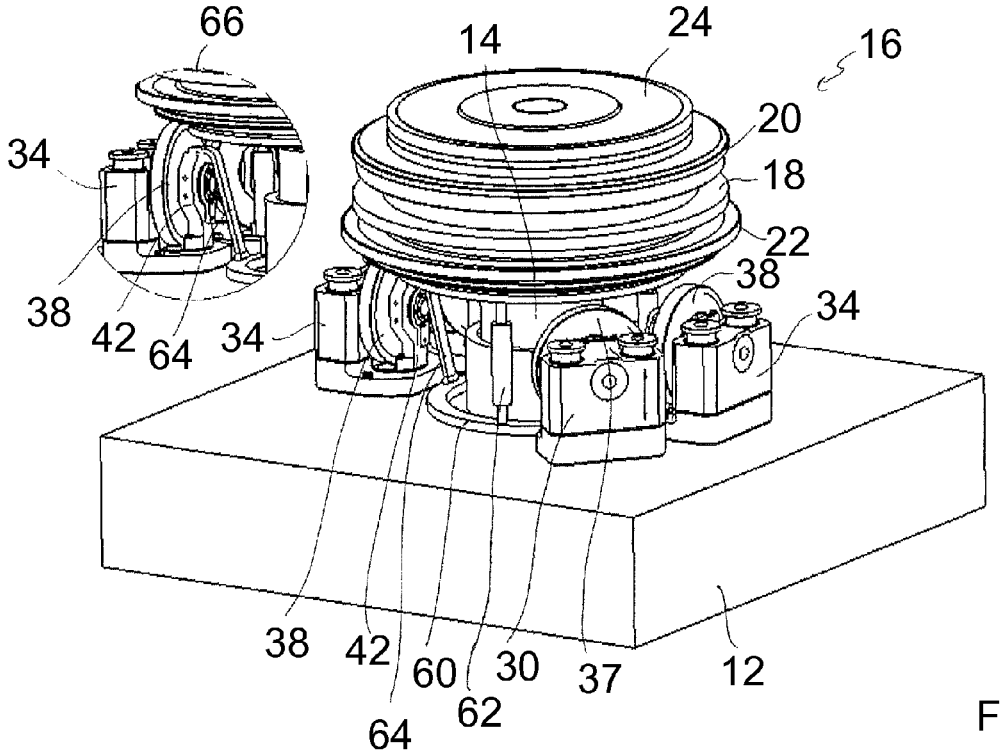
FIG. 4 is a perspective view along with an enlarged sectional representation of a part of a rotary press according to a fourth exemplary embodiment of the teachings herein.

FIG. 4 shows a further example embodiment of a rotary press according to the teachings herein that corresponds largely to the example embodiment from FIG. 1. As in FIG. 3, the upper carrier plate 10 and the upper pressing stations are not shown for illustrative purposes. With the example embodiment shown in FIG. 4, a lifting ring 60 is mounted rotatably on the lower carrier plate 12, and engages at the lower cam 26 of the rotor 16 via a plurality of lifting rods 62. In the example shown, four engagement rods 64 are mounted pivotably at the lifting ring 60. The engagement rods 64 start from the surface of the lifting ring 60 to extend upward and at the free ends thereof are angled outward. As seen in particular in the enlarged representation 66 in FIG. 4, the engagement rods 64 can be brought into engagement with the fork plates 42 of the lower pressing stations by suitable pivoting, in particular they can be pivoted over the upper side of the fork plates 42. If in this engagement setting, the lower pressing stations are moved upward via the lower pressing station drives, they via the engagement rods 64 take along the lifting ring 60, which in turn via the lifting rods 62 takes the rotor 16 upward into the removal position. The engagement rods 64 can be brought out of engagement with the fork plates 42 of the lower pressing stations by a corresponding return pivoting.

Figure 5:
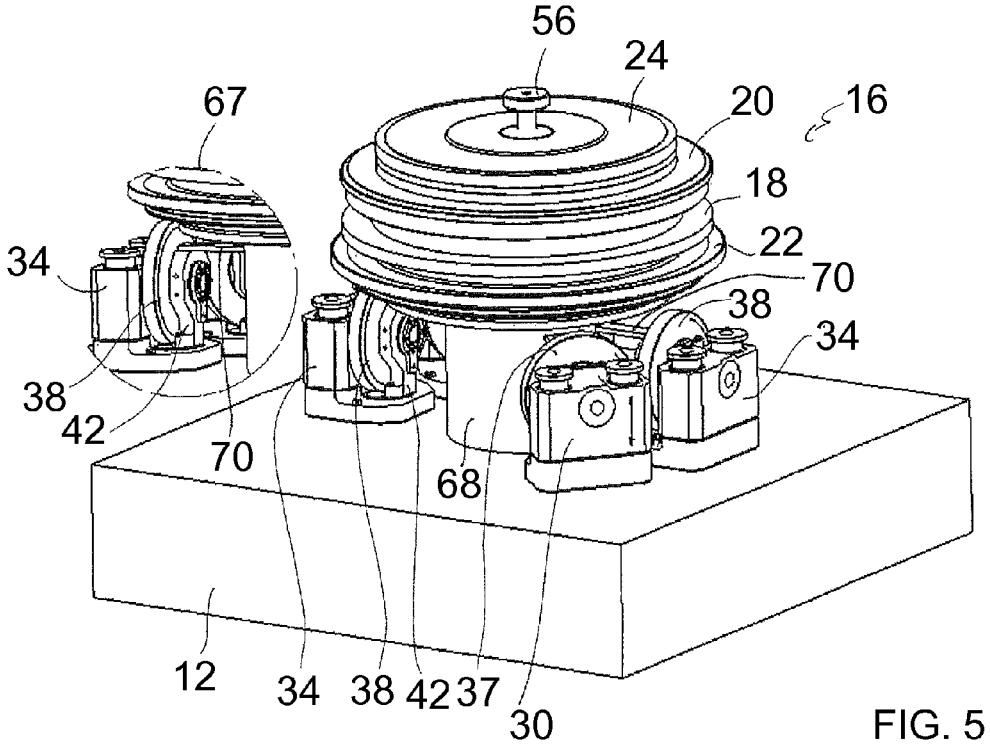
FIG. 5 is a perspective view along with an enlarged sectional representation of a part of a rotary press according to a fifth exemplary embodiment of the teachings herein.

FIG. 5 shows an alternative implementation. This example embodiment corresponds largely to the example embodiment shown in FIG. 4. In contrast to FIG. 4, however, there is no lifting ring 60 with lifting rods 62 and engagement rods 64, rather there is a lifting collar 68 surrounding the rotor shaft 14 rotatable manually or by means of a suitable drive. The lifting collar 68 in the example shown has four engagement brackets 70, which extend outward starting from the upper side of the lifting collar 68. As seen in FIG. 5, again in an enlarged sectional representation 67, the engagement brackets 70 can be brought into engagement with the fork plates 42 of the lower pressing stations by suitable rotation of the lifting collar 68, in particular in such a manner that they cover the upper side of the fork plates 42 in a manner similar to the engagement rods 64 provided with the example embodiment of FIG. 4. Analogous to the example embodiment of FIG. 4, with an upward movement, the lower pressing stations, via the engagement brackets 70, take along the lifting collar 68 and thus the rotor 16 into the removal position.

Figure 6:
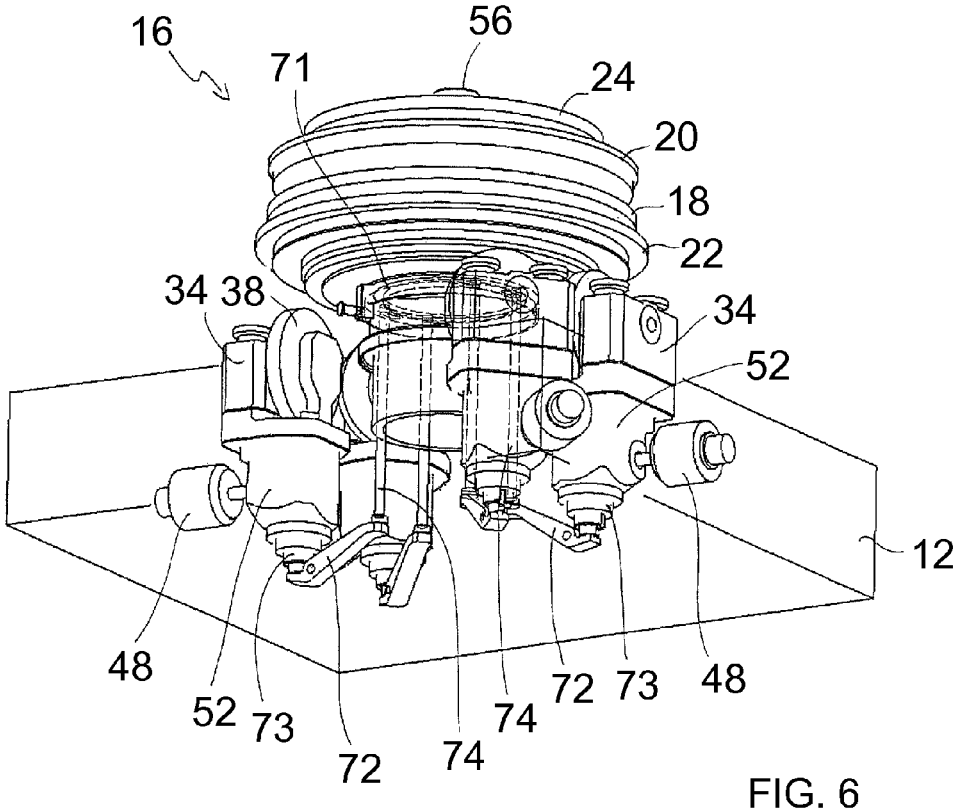
FIG. 6 is a partially transparent, perspective representation of a part of a rotary press according to a sixth exemplary embodiment of the teachings herein.

FIG. 6 shows a further example embodiment, which again corresponds largely to the example embodiment shown in FIG. 4. In contrast to the example embodiment of FIG. 4, with this example embodiment there is a rotatable lift ring 71. The lift ring 71 can be rotated both manually and also by means of a suitable drive. With the example embodiment of FIG. 6, lift levers 72 are provided coupled on one side to the lower pressing stations and on the other side to the rotor 16. In the example shown, in each case a spindle 73 of a lower pressing station spindle drive engages at one end one of a lift lever 72, wherein the spindle 73 and the lift lever 72 are coupled together in an articulated manner. The other end of the lift lever 72 is connected, also in an articulated manner, in each case to a lifting rod 74 acting on the rotatable lift ring 71. By rotating the lift ring 71, it can be brought selectively into engagement with the rotor 16 or out of engagement with the rotor 16. With a downward movement of the lower pressing station drives, in particular the spindles 73, the lift ring 71 and, with appropriate engagement with the rotor 16, the rotor 16 move upward into the removal position via the lift levers 72 and the lifting rods 74.

It is understood that with all example embodiments, the rotor can be raised both out of its operating position into its removal position, as well as lowered out of its removal position into its operating position. All coupling means described above between the pressing station drives and the rotor can be permanently provided on the rotary press, or provided temporarily, thus removably, such that they are installed only for a raising or lowering of the rotor on the rotary press.

What is claimed is:

1. A rotary press, comprising:

a press frame;

a rotor arranged on the press frame for rotational movement, the rotor having:

a die plate;

an upper punch receiver for receiving upper punches;

a lower punch receiver for receiving lower punches;

an upper cam for carrying upper cam elements for guiding the upper punches;

a lower cam for carrying lower cam elements for guiding the lower punches;

at least one drive;

an upper pressing station having an upper pressing roller;

a lower pressing station having a lower pressing roller; and coupling means for coupling a respective drive of the at least one drive to the rotor in such a manner that, with a movement of the at least one drive, the rotor is raised out of an operating position for producing pressing, and into a removal position, wherein the rotor is removable from the removal position out of the press frame in a lateral direction relative to a mounting surface of the press frame, wherein the coupling means for a first drive of the at least one drive comprises at least one tractive element, each tractive element attached on one side to a fork plate supporting the upper pressing roller of the upper pressing station, and attached on another side to the rotor.

2. The rotary press according to claim 1, wherein the at least one drive is at least one dosing station drive that adjusts a height of at least one dosing station in which material to be pressed is filled into receivers in the die plate.

3. The rotary press according to claim 1, wherein each drive of the at least one drive is a pressing station drive that adjusts a height of one of the upper pressing station or the lower pressing station.

4. The rotary press according to claim 1, wherein:

each tractive element is attached at a support attachment piece arranged at the upper cam; and in the removal position of the rotor, a removal arm of a removal device engages at the support attachment piece for removal of the rotor out of the press frame.

5. The rotary press according to claim 1, wherein each tractive element is releasably attached to at least one of the upper pressing station or the rotor.

6. The rotary press according to claim 1, wherein each tractive element is a pull rod.

7. The rotary press according to claim 3, wherein the coupling means for a second drive of the at least one drive comprises at least one push element, each push element attached on one side to a fork plate supporting the lower pressing roller of the lower pressing station, and attached on another side to the rotor.

8. The rotary press according to claim 7, wherein each push element is a push bracket.

9. The rotary press according to claim 7, wherein each push element is releasably attached to at least one of the lower pressing station or the rotor.

10. The rotary press according to claim 3, further comprising:

a rotor shaft coupled to the rotor, wherein the coupling means of a second drive of the at least one drive comprises:

a lifting collar mounted rotatably surrounding the rotor shaft and resting against the rotor; and at least one engagement element, each of which is brought selectively into and out of engagement with the lower pressing station through rotation of the lifting collar, wherein with an engagement between the lower pressing station and the at least one engagement element, the lifting collar and the rotor are raised by an upward movement of the lower pressing station.

11. The rotary press according to claim 3, wherein the coupling means of a second drive of the at least one drive comprises:

a rotatably mounted lift ring; and at least one engagement element on the rotatably mounted lift ring that is brought selectively into and out of engagement with the rotor through rotation of the rotatably mounted lift ring, wherein with engagement between the rotor and the at least one engagement element, the lift ring and the rotor are raised by a movement of the lower pressing station.

12. The rotary press according to claim 11, wherein the coupling means of a third drive of the at least one drive comprises at least one lift lever, each lift lever coupled on one side to at least one lower pressing station drive that adjusts the height of the lower pressing station and on another side to the rotor, wherein the rotor, with a downward movement of the lower pressing station by the at least one lower press station drive, is raised by the at least one lift lever.

13. The rotary press according to claim 12, wherein each lift lever is coupled to the rotor via at least one element, engaging at the rotor.

14. The rotary press according to claim 3, wherein each pressing station drive is a spindle drive.

15. The rotary press according to claim 12, wherein one of a spindle or a spindle nut of the lower pressing station drive is coupled to the at least one lift lever.

16. The rotary press according to claim 3, wherein the coupling means of a second drive of the at least one drive comprises at least one lift lever coupled on one side to at least one lower pressing station drive that adjusts the height of the lower pressing station and on another side to the rotor, wherein the rotor, with a downward movement of the lower pressing station by the at least one lower press station drive, is raised by the at least one lift lever.

* * * * *